United States Patent [19]

Cordier

[11] Patent Number: 4,592,295

[45] Date of Patent: Jun. 3, 1986

[54] AUTOMATIC SHIRT CUFF MANUFACTURING UNIT

[75] Inventor: Bernard Cordier, Paris, France

[73] Assignee: Fives-Cail Babcock, Paris, France

[21] Appl. No.: 612,354

[22] Filed: May 21, 1984

[30] Foreign Application Priority Data

May 25, 1983 [FR] France ..... 83 08602

[51] Int. Cl.[4] ..... D05B 3/04

[52] U.S. Cl. ..... 112/65; 112/121.14; 112/121.29; 112/155; 112/121.12

[58] Field of Search ..... 112/121.12, 121.14, 112/121.29, 65, 155, 121.15, 2

[56] References Cited

U.S. PATENT DOCUMENTS

| | | | |
|---|---|---|---|
| 947,605 | 1/1910 | Tillie | 112/155 X |
| 2,249,423 | 7/1941 | Galkin | 112/155 |
| 3,191,557 | 6/1965 | Moore | 112/121.15 X |
| 3,468,273 | 9/1969 | Lester | 112/155 X |
| 3,773,002 | 11/1973 | Burton | 112/121.27 X |
| 3,965,831 | 6/1976 | Weir | 112/155 X |
| 3,974,786 | 8/1976 | Bianchi | 112/121.12 |

*Primary Examiner*—H. Hampton Hunter
*Attorney, Agent, or Firm*—Kurt Kelman

[57] ABSTRACT

There is provided an automatic shirt cuff manufacturing unit comprising an overcast stitching machine, a buttonhole forming machine and a button sewing machine. The unit includes means for conveying the cuff to the overcast stitching machine, means for removing the cuff from the overcast stitching machine, means for positioning at least one of the ends of the cuff with respect to one of the working heads of the buttonhole forming and button sewing machines, the working heads of said machines being arranged opposite one another, means for orienting the cuff so that it assumes the proper orientation, or an orientation at 180° from it, under the working heads, means for bringing the cuff under said heads while maintaining it in correct position, and means for removing the cuff from the machines.

26 Claims, 11 Drawing Figures

FORMING MACHINE
24
44
48
PROGRAMMABLE CONTROLLER
ACTUATORS
7
9
10
13
14
29
90
92
25
18
20
36
40-46
42
51
83
62
59
71
72
73
SENSORS / DETECTORS
CP
Fc7
Fc'7
Fc10
Fc14
Fc13
17
Fc'14
Fc''14
Fc'10
Fc29
Fc90
Fc92
Fc25
Fc18
Fc20
Fc'29
Fc36
41
Fc40
Fc46
Fc62
Fc59
Fc42
Fc'62
Fc72
Fc73

AUTOMATIC SHIRT CUFF MANUFACTURING UNIT

The present invention relates generally to the manufacture of garments, and more particularly it relates to the production of cuffs for shirt sleeves.

Installations comprising a forming machine, an overcast stitching machine, a buttonhole forming machine and a button sewing machine are known.

The present invention is concerned with a cuff manufacturing unit wherein the above identified machines are disposed so as to automate the operations performed thereby. To this end, the present invention provides means in the cuff manufacturing unit for transferring the cuff from one machine to another, as well as means for controlling the position of the cuff during its movement through the various stations of the cuff manufacturing unit.

The present invention is concerned essentially with an automatic manufacturing unit for shirt cuffs, comprising an overcast stitching machine, a buttonhole forming machine and a machine for sewing the button on the cuff. In addition, the unit includes means for conveying the cuff to the overcast stitching machine, means for removing the cuff from the overcast stitching machine, means for positioning at least one of the ends of the cuff with respect to one of the working heads of the buttonhole forming and the button sewing machines, the working heads of said machines being arranged opposite one another, means for orienting the cuff so that it assumes the proper orientation, or an orientation at 180° from it, under the working heads, means for bringing the cuff under said heads while maintaining it in correct position, and means for removing the cuff from said machines.

The manufacturing unit may furthermore include a forming machine positioned upstream of the overcast stitching machine, means for transferring the cuff from one machine to another, a storage stacker positioned downstream of the buttonhole forming and button sewing machines and means for transferring the cuff from these machines to the stacker and for introducing it into the same.

According to a particular embodiment, a magazine is provided between the forming machine and the overcast stitching machine.

The means for orienting the cuffs includes a rotatable tray having a vertical axis, the plane of which is positioned at the same level as the table of the overcast stitching machine and the table of the buttonhole forming and button sewing machines.

The means for positioning the cuff includes a pushing device which brings the line on which the button and buttonhole of the cuff lie into coincidence with a diameter of reference of the tray. According to a first embodiment, these means, in addition, include a device making it possible to set the ends of the cuff in position so that they are a predetermined distance from one another corresponding to the distance between the working heads of the buttonhole forming and button sewing machines. According to another embodiment, these means comprise a device for moving the cuff longitudinally in order to position one of its ends with respect to the working head of one of the buttonhole forming or button sewing machines, said machine being stationary, for detecting the other end of the cuff and controlling the movement of the other machine which is moveable, so as to adjust the distance between the working heads to the size of the cuff.

The direction of movement of the cuff from the overcast stitching machine to the revolving tray, on the one hand, and of the tray towards the buttonhole forming and button sewing machines, on the other hand, can be either parallel or perpendicular. The amplitude and direction of rotation of the tray depends on the layout selected and on the type of cuff (right or left) being made. With the arrangement for parallel movement, for a first type of cuff (left or right), it is not necessary to rotate the tray, the cuff simply being moved in translation from the overcast stitching machine towards the buttonhole forming and button sewing machines with a stop on the tray in order to position it; for the other type of cuff, the tray is rotated 180° before transferring the cuff to said machines. With the arrangement for perpendicular movement, the tray must be rotated through 90° in one direction or the other, depending on the type of cuff, before transferring the cuff to the buttonhole forming and button sewing machines. The different positions in which the tray is positioned and held for a certain time are determined by stops, some of which are retractable in the case of the arrangement for perpendicular movement.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
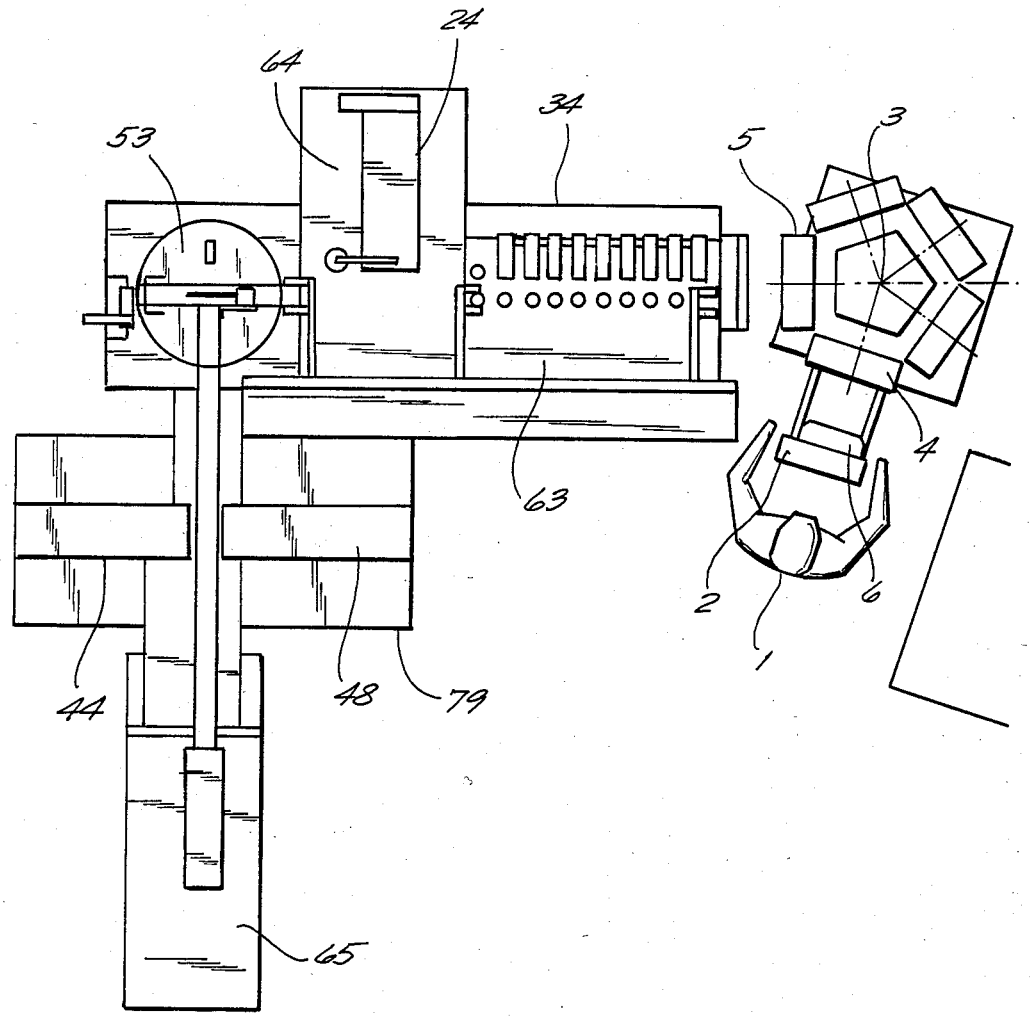
FIG. 1 is a plan view showing schematically a first embodiment of the automatic shirt cuff manufacturing unit according to the present invention.

Now turning to the drawings, there is shown in FIG. 1 a forming machine of the usual type consisting of an assembly of five trays, designated 4, revolving about a vertical axis 3 in the manner of a carousel. Reference numeral 1 designates the operator who introduces a folded cuff in the feed 2 of the machine. This machine returns the heat sealed cuff 6 to station 5 after tray 4 has successively occupied the different stations of the forming machine during its rotation about axis 3.

Cuff 6 is then brought by means described hereinafter to table 63 of a magazine 34. Each cuff 6 is successively brought by means also described hereinafter to table 64 of an overcast stitching machine 24 and then to a vertical axis rotatable tray 53. Tables 63 and 64 as well as the tray 53 are all positioned at the same level. From tray 53 cuff 6 is brought to table 79 supporting a button setting machine 44 which is arranged to face a buttonhole forming machine 48. Table 79 is also arranged at the same level as tables 63 and 64 but the direction of movement of cuff 6 is perpendicular to the direction of movement of said cuff on tables 63 and 64.

Figure 2:
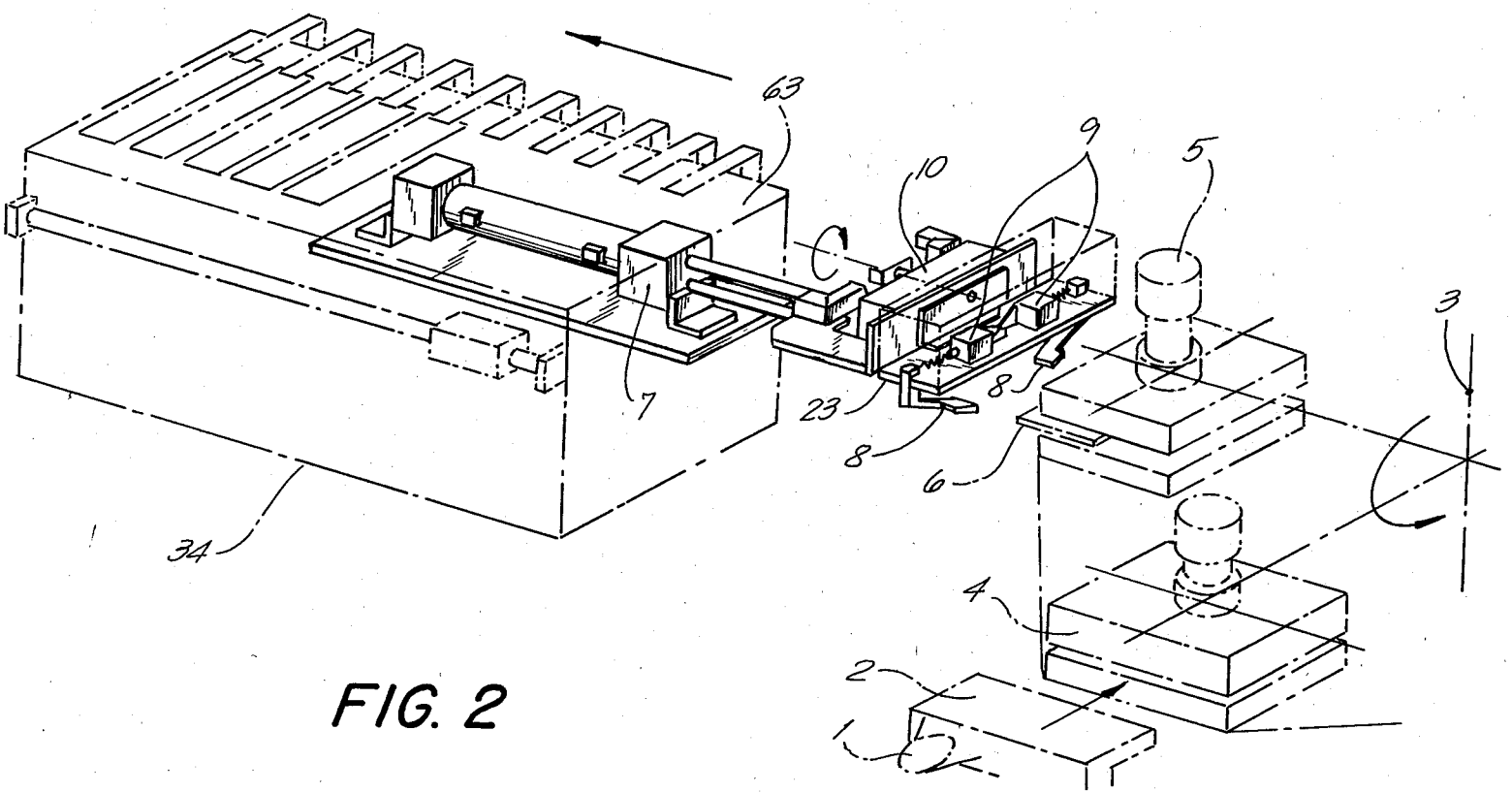
FIG. 2 is a perspective view of the forming machine and means for transferring the cuff from said machine to a magazine.

In FIG. 2 it can be seen that heat sealed cuff 6 is located at station 5 of the forming machine facing a grasping device. This device consists of a pair of grasping arms 8 controlled by two electromagnets 9 and mounted on a base 23 attached to a horizontal axis rotary fixture 10 the body of which is fastened to the end of a double shaft actuator 7. By rotation through 180°, base 23 is brought even with table 63, the cuff now being located on the base.

Figure 3:
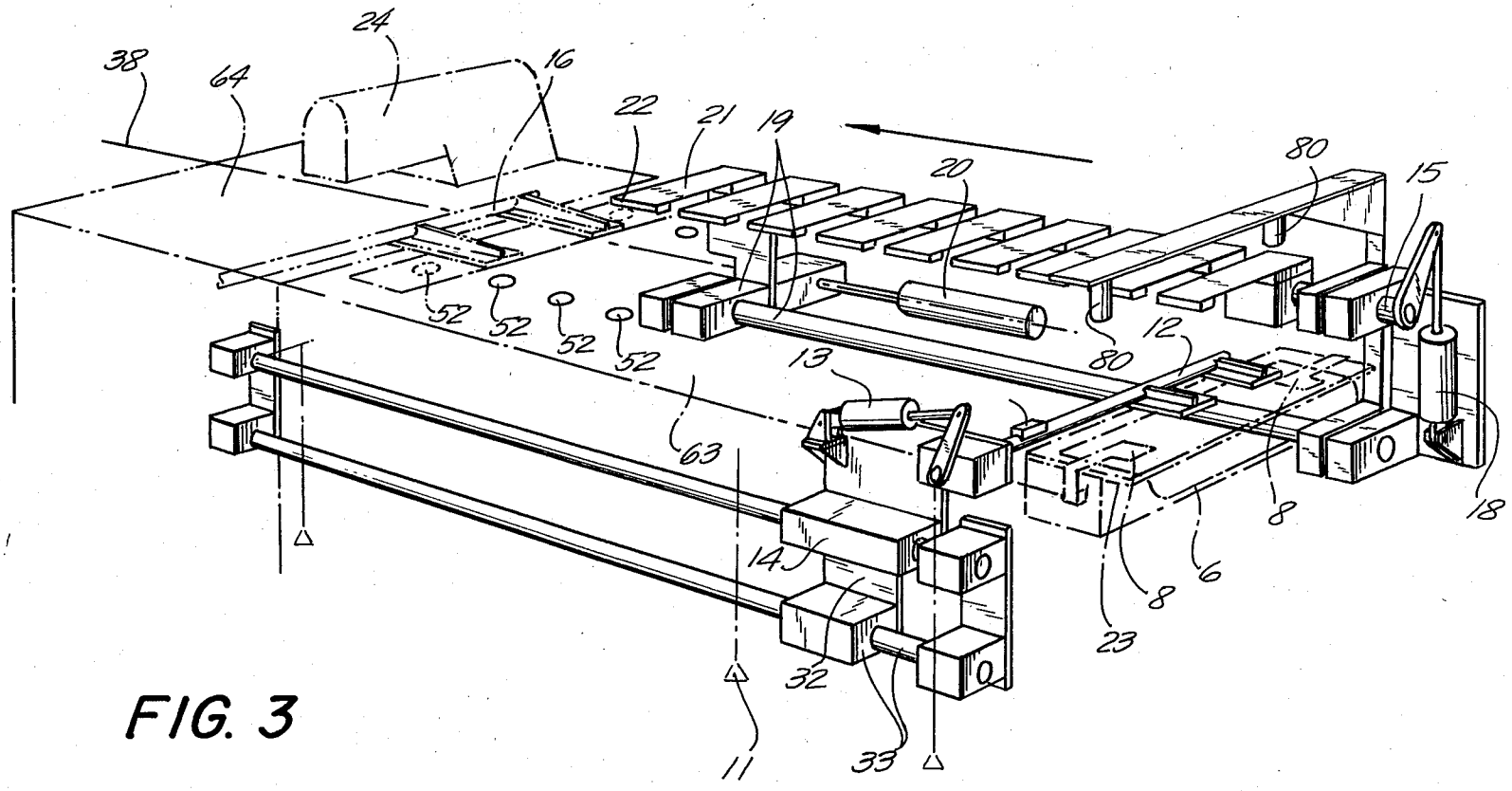
FIG. 3 is a perspective view of the magazine and means for transferring the cuff to the table of the overcast stitching machine.

As clearly seen in FIG. 3, the correct position of cuff 6 at station 5 is detected by optical fiber cells 80. Magazine 34 (FIG. 1) with a capacity of 10 cuffs, for example, permits the part-time utilization of the forming machine, whose rate of production is double that of the equipment downstream.

FIG. 3 shows how magazine clamp 12 supplies the ten stations of magazine 34 by clamping cuff 6 when grasping arms 8 have been released by electromagnets 9. This clamping action is provided by a magazine clamp pneumatic cylinder actuator 13. Magazine clamp 12 and cuff 6 are moved by sliding over base 23 then onto table 63, being displaced linearly by a shaftless hydraulic magazine positioner 14, a clamp bearing carriage 32 being guided by a shaft, e.g., with a ball-type shaft bushing system 33.

A cuff detector 17, fixed with respect to magazine clamp 12, causes magazine clamp 12 to stop at the station of magazine 34 immediately preceding a station occupied by a cuff 6. Taking into account the response time of the control elements, the stopping position is tied to the speed of advance of hydraulic magazine positioner 14. Magazine clamp 12 then releases cuff 6 which is held in position on table 63 by suction openings 52. The rotation of rotary fixture 10 occurs always with the shafts of actuator 7 retracted. In order for clamp 12 not to hinder this rotation, a holding position 11 is provided for it.

A step-wise transfer of cuff 6 is controlled by lever 21 fixed on shaft 15 and pivotally driven by lever actuator 18. Shaft 15 is attached to pneumatic stepping cylinder actuator 20, providing the stepping movement via a sliding shaft; e.g., a ball-type shaft bushing system. Levers 21 providing the step-wise transfer of cuffs 6 to table 63 are each formed of a spring blade provided at its end with a rubber boot 22.

Figure 4:
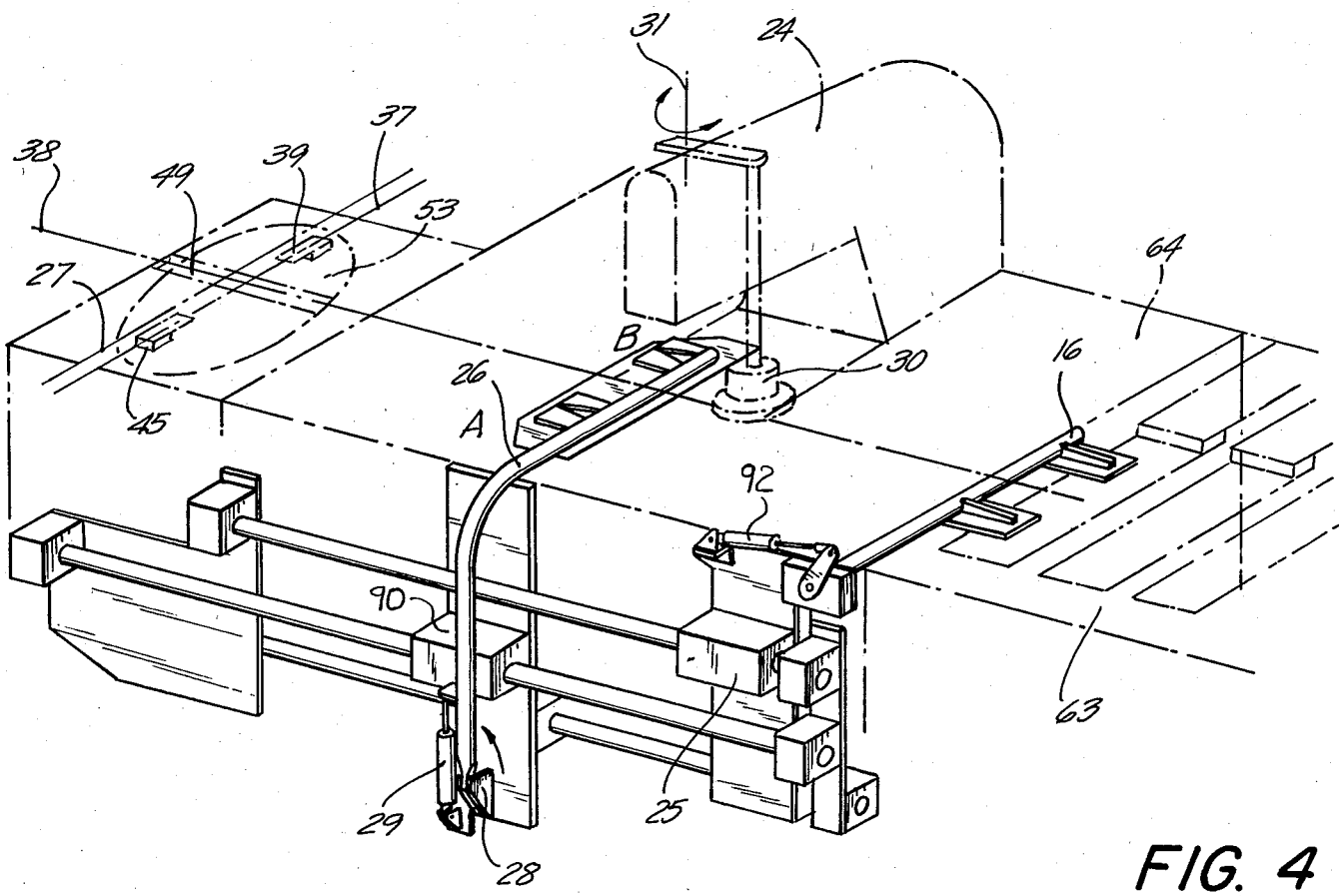
FIG. 4 is a perspective view of the overcast stitching machine and means for transferring the cuff to the rotatable tray.

The cuff transfer from magazine 34 for feeding overcast stitching machine 24 is clearly shown in FIG. 4. This transfer is provided by a stitching machine clamp 16 which transfers cuffs 6 in a manner similar to that of magazine clamp 12 clamp 16 is operated by clamp actuator 92. Stitching machine positioner 25 is of the shaftless pneumatic type in this case. Stitching machine 24 is of a usual type and performs the overcast stitching operation in a known manner.

An arm 26 transfers the overcast stitched cuff 6 from machine 24 to rotatable tray 53, which is positioned following tables 63 and 64 and disposed at the same level. Arm 26 is articulated on an axis 28 about which it rocks under the action of an arm actuator 29. Linear actuator 90 moves arm 26 from machine 24 to rotatable tray 53. This arrangement offers the advantage of making it possible to have the arm pass in front of machine 24 while shoe 30 of said machine turns about its axis 31 to manipulate cuff 6 during the overcast stitching operation.

Figure 5:
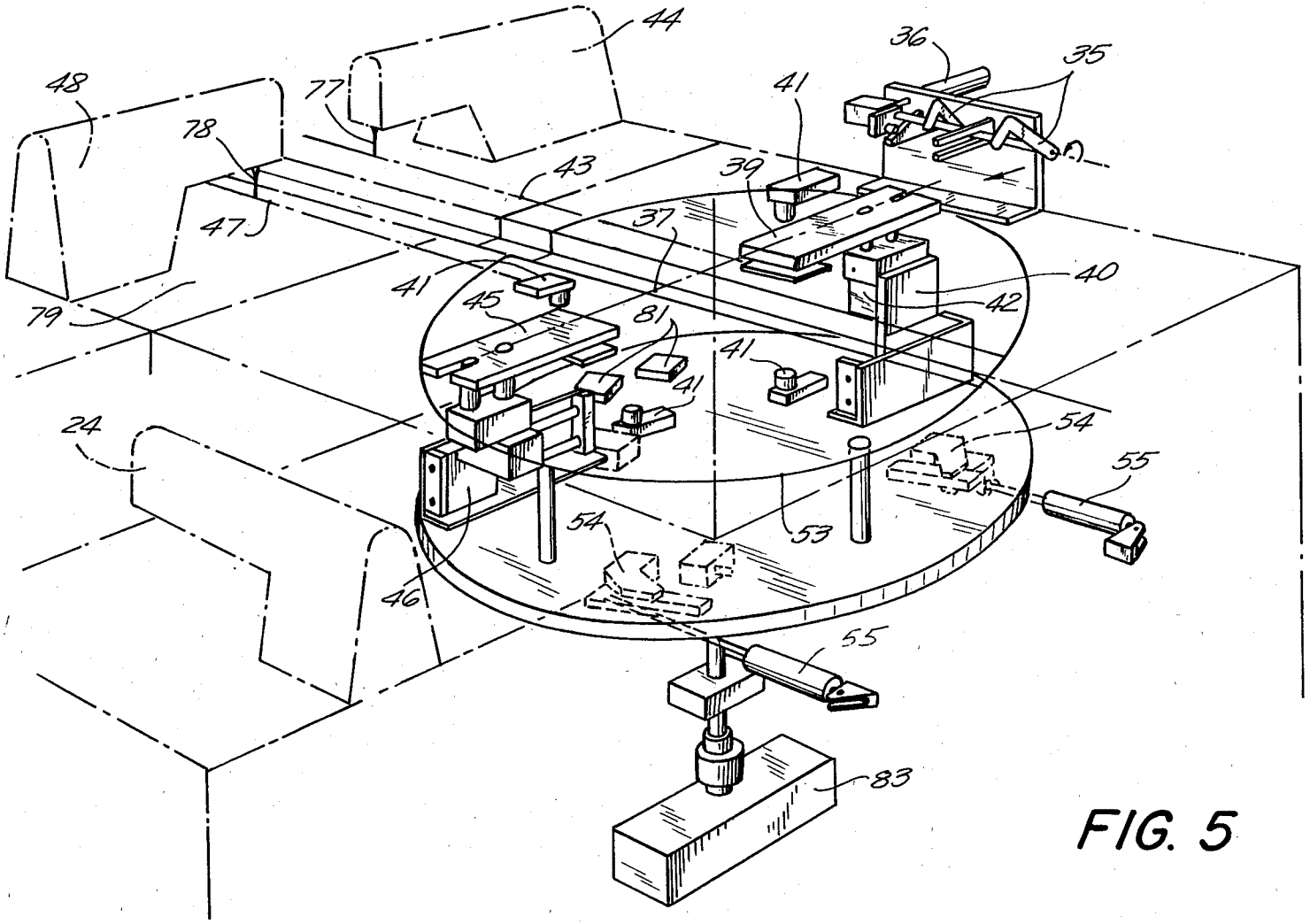
FIG. 5 is a perspective view of the rotatable tray.

Rotatable tray 53 is intended to position the cuff so that a theoretical line 27, joining the location points A and B of the button and the buttonhole, is parallel with the plane defined by the axes 77 and 78 of the working heads of machines 44 and 48 and the distance separating the points A and B is equal to the distance between the axes of the two heads (shown in phantom in FIG. 5).

Upon removal from the overcast stitching mahine, cuff 6 is not always correctly positioned and the first operation consists of causing line 27 to coincide with the diameter 37 of the rotatable tray. As clearly seen in FIG. 5, when tray 53 is in a first position which it occupies when the cuff is brought to it by the stitching machine clamp 16, this diameter is perpendicular to the direction of travel of the cuff along the tables 63 and 64, as represented in the drawing by line 38. After arm 26 has been removed from rotatable tray 53, the cuff is pushed by two fingers 35 driven by finger actuator 36 until line 27 coincides with diameter 37 of the tray; the fingers 35 are then raised and brought to the retracted position by the finger actuator 36. The assembly formed by fingers 35, the device controlling the movements of the fingers and their support is mounted in a fixed position diametrically opposed to the overcast stitching machine with respect to the center of the tray.

Once this position has been assumed, rotatable tray 53 takes charge of cuff 6. To this end, a first cuff clamp 39 moved in translation by a pneumatically controlled carriage 40, leaves its rear stop position and moves towards the center of the tray to pick up one end of cuff 6 as soon as, during the advance, a photoelectric cell 41 carried by first cuff clamp 39 detects the edge of said cuff and activates the electromagnet 42 closing first cuff clamp 39, which then takes the cuff 6 to the end of travel of carriage 40.

Simultaneously, and by an identical process, a second cuff clamp 45 picks up the other end of cuff 6 after its edge has been detected, and takes it to the end of travel of its carriage 46.

During the advance of cuff clamps 39 and 45, cuff 6 forms a downwardly oriented buckle inside channel 49 formed diametrically in rotatable tray 53 perpendicular to line 37 as shown in FIG. 4. This is accomplished by means of a prong 50 controlled by an electromagnet 51, as clearly seen in FIG. 6. Prong 50, by lowering instantaneously, folds cuff 6 downward, without which the position of the buckle would be a random one, possibly above tray 53.

Adjustable stops determine the ends of travel of carriages 40 and 46 so that, after the operations described above, the distance separating point A, where the button is to be sewn, and point B, where the buttonhole is to be formed, is equal to the distance between axes 77 and 78 of the heads of machines 44 and 48, regardless of the size of the cuff (FIG. 5).

The positions of the cells 41 on the cuff clamps 39 and 45 are adjustable and set as a function of the distances separating points A and B from the adjacent edges of the cuff.

When cuff 6 is correctly positioned, rotatable tray 53 rotates through 90°; the rotational drive of the tray being provided by a rotary pneumatic drive 83. The rotation occurs in one direction or the other, according to whether the cuff is right hand or left hand. The overcast stitched cuff always arrives in the same position on tray 53, which is turned 90° in one direction for a right hand cuff and in the opposite direction in the case of a left hand cuff, so as to bring the points A and B in alignment with axis 77 of the working head of machine 44 and the axis 78 of the working head of machine 48, respectively. By rotation through 90° the line 27 joining points A and B is brought parallel with the plane containing axes 77 and 78 of machines 44 and 48.

The position of tray 53 when it receives the cuff from the overcast stitching machine is determined by two retractable stops 54 controlled by two pneumatic cylinder actuators 55.

The two positions to which the tray is brought by rotation through 90°, in one direction or the other, are determined by two fixed stops 81. These stops are placed under the tray and cooperate with studs fixed in the tray. In order to turn the tray from its first position, in one direction or the other, it is necessary first to retract the corresponding stop 54; this stop must also be retracted to enable the tray to return to its first position.

Figure 6:
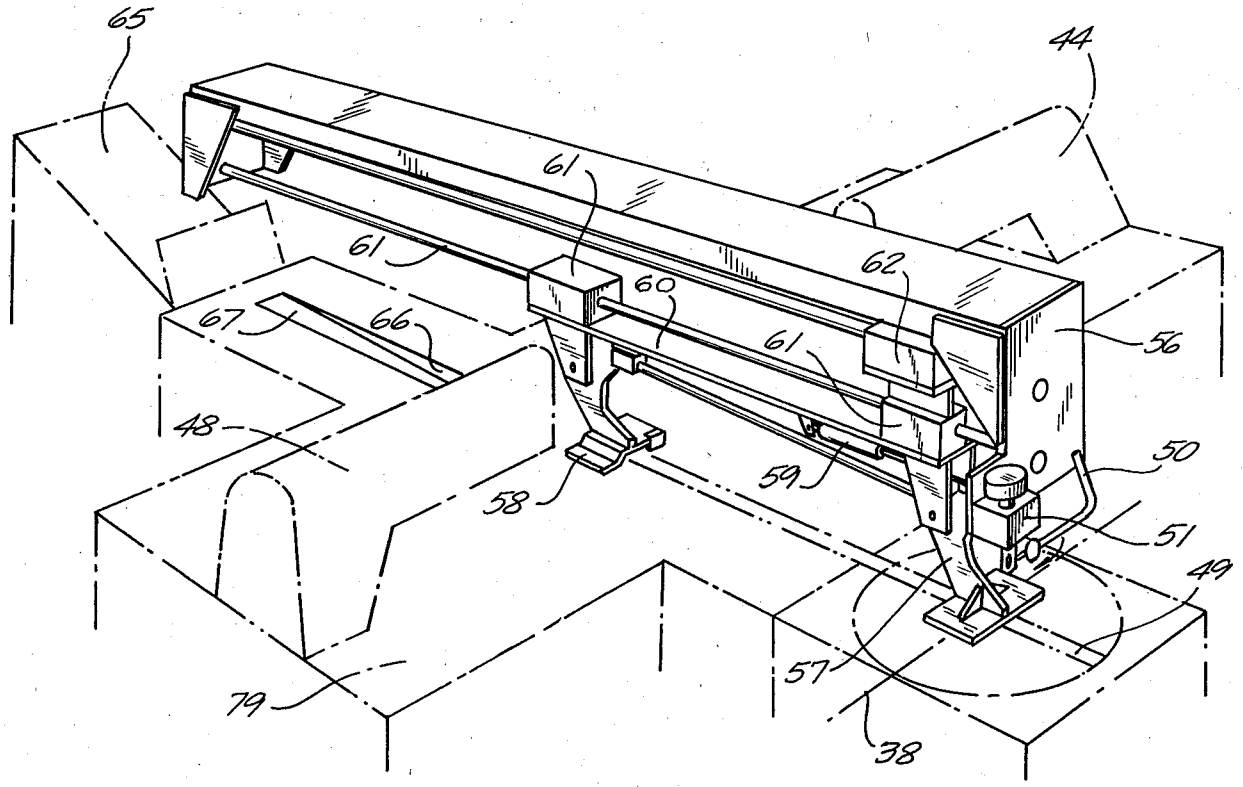
FIG. 6 is a perspective view of the means for transferring the cuff from the rotatable tray to the buttonhole forming and button sewing machines and for removing it to a stacker.

After the rotation of tray 53, cuff 6 is picked up by a transfer arm 56, as seen clearly in FIG. 6. This arm is equipped with two arm pincers 57 and 58 controlled by a single pneumatic cylinder arm actuator 59. These pincers and the actuator are carried on a carriage 60 guided by a ball type shaft-bushing system 61 and driven by a shaftless pneumatic cylinder carriage actuator 62. This assembly is constructed so that it can be interposed between the working heads of machines 44 and 48 to serve for the corresponding operations.

First arm pincer 57 is made so that it can pass between clamps 39 and 45 in order to recover cuff 6 on rotating tray 53 (FIG. 5). Clamps 39 and 45 release the cuff only after arm pincer 57 has been applied to it, so that it cannot change position accidentally.

The cuff is brought under the working heads of machines 44 and 48 by first arm pincer 57 sliding over the tray 53 and the table 79, the travel of points A and B being represented in FIG. 5 by lines 43 and 47. In the table 79 is formed a channel 66 which extends from channel 49 in tray 53 when the tray has completed a 90° rotation (see FIG. 6) and in which moves the buckle formed by the cuff during its transfer from tray 53 to machines 44 and 48.

When the cuff has received its buttonhole and its button, second arm pincer 58 removes it to a stacker 65. This pincer holds cuff 6 by a single side in order to allow it to unfold as it comes out of channel 66, aided in this by inclined plane 67 which extends from the flat bottom of the channels 49 and 66. At the same time as a cuff is removed towards the stacker, another cuff is brought by first arm pincer 57 to machines 44 and 48.

First arm pincer 57 and second arm pincer 58 are mounted on carriage 60 and move over channel 49, together as a unit. Both pincers 57, 58 perform the same movement simultaneously. As pincer 57 clamps down on a cuff on tray 53, in preparation for transferring to the cuff machines 44 and 48, pincer 58 simultaneously clamps down on the preceding cuff which has already received its buttonhole and button, and is to be transferred next to stacker 65. Both pincers 57 and 58 operate to clamp and release their respective workpieces by a single pneumatic actuator 59, as previously mentioned. As further detailed below in Table 1, pincers 57 and 58 perform a clamp, transfer, release, and return sequence.

Figure 7:
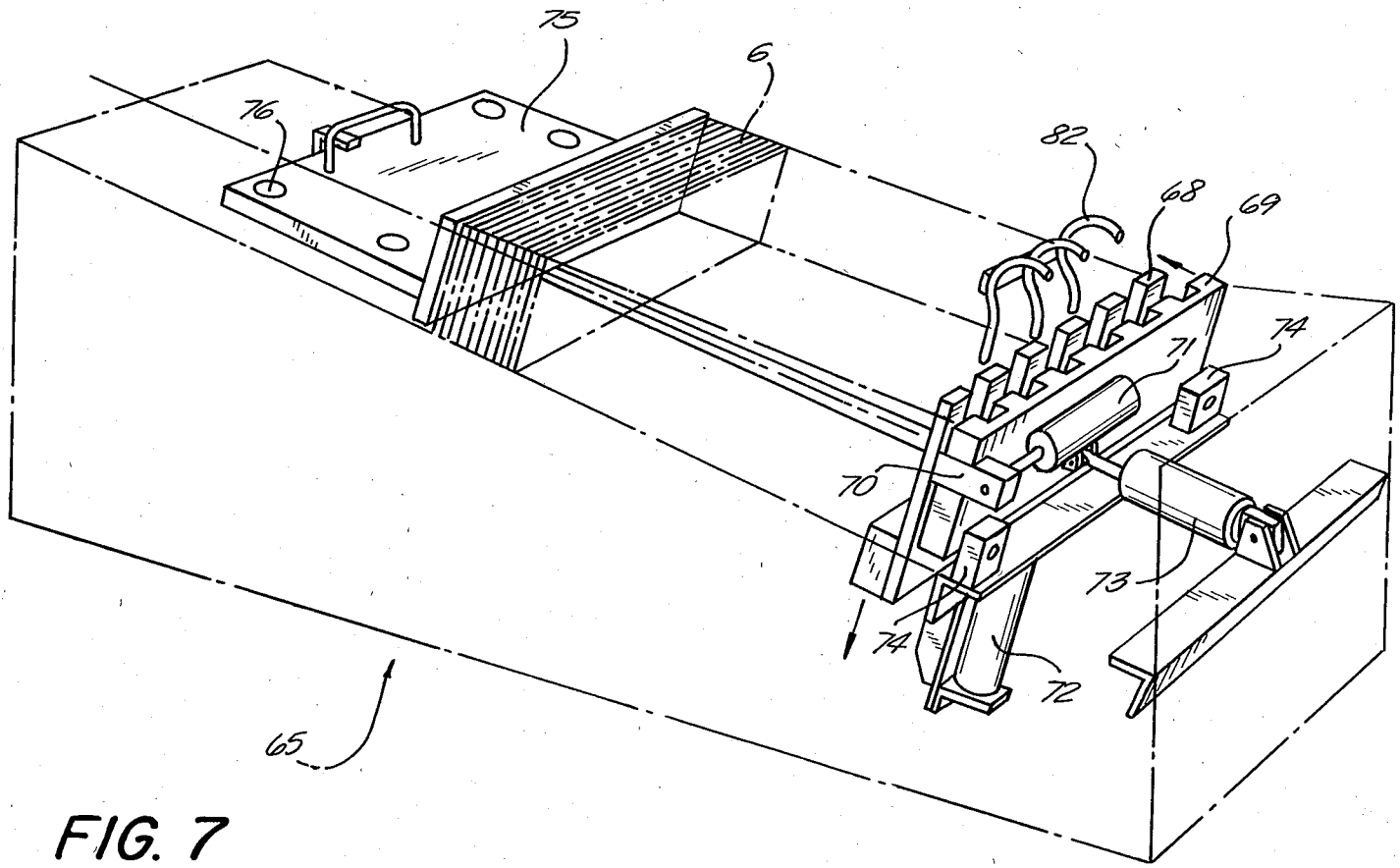
FIG. 7 is a perspective view of the stacker.

In FIG. 7 can be seen a deflector 82 which forces cuffs 6 released by second arm pincer 58 to fall in between a grate 68 and a pusher 69, of complementary forms. Cuffs 6 are staggered laterally and alternately to the left and to the right under the action of a bracket 70 attached to a lateral actuator 71 having a short travel in order to prevent the superposition of the buttons in the stacker.

The vertical retraction of grate 68 is caused by a longitudinal actuator 72, which makes it possible for the previously stored cuffs to come in contact with cuff 6 introduced between grate 68 and pusher 69. A constant pressure on the stacked cuffs is provided by a carriage 75 rolling over the stacking plane of stacker 65 by means of ball-type rollers 76. Pusher 69 advances by a few centimeters under the action of longitudinal actuator 73 until it is over grate 68. Pusher 69 is guided by a ball type shaft-bushing system 74. Grate 68 then comes up in the corresponding guides of pusher 69. The pusher moves back to its starting position and stacker 65 is then ready to receive a new cuff 6.

The control system for the elements just described as well as the machine heads control can be provided by a programmable robot or by a microprocessor system. The particular programmable controller employed in the invention is commercially available from the French firm SYRELEC, as model SLP 2010 althrough other controllers might also be used. The interconnections between the programmable controller and the sensors and actuators are further described in detail hereinafter in Table 1. Each end of travel position is detected by a proximity sensor and transmitted to the robot, for example. In most cases the rapid movements of the actuators are decelerated at the end of their travel by means of hydraulic dampers.

The entire system of the different stations operates advantageously in the automatic mode. A single operator is required for the insertion of the cuff in the feeder of the forming machine.

An in-line configuration of the overcast stitching station, rotatable tray and buttonhole forming-button setting station would make it possible to do without the retractable stops. Nevertheless, the right angle layout of these stations on either side of the rotatable tray, as described above, is advantageous from the standpoint of space utilization.

Figure 8:
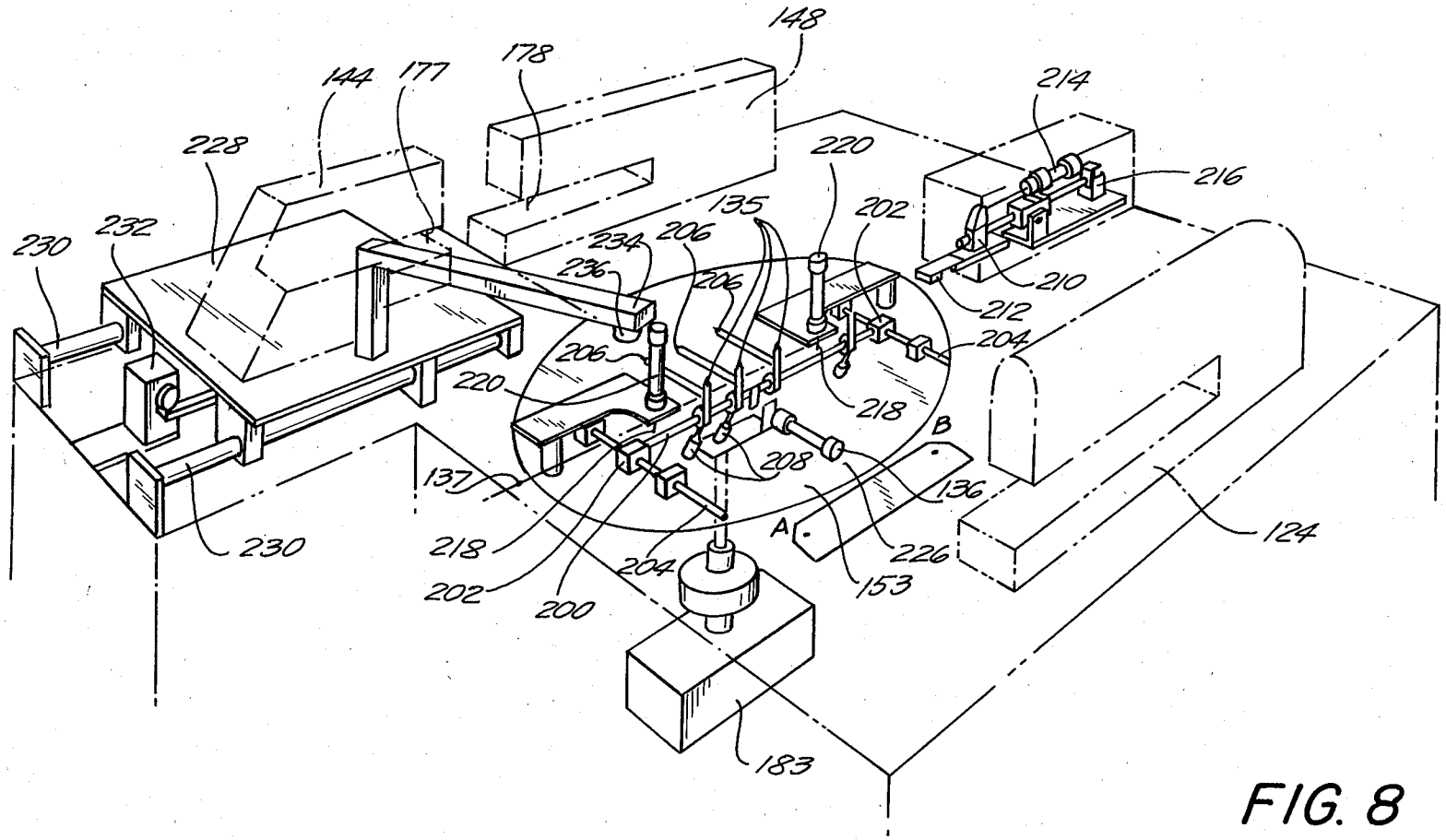
FIG. 8 is a perspective view of a portion of the automatic shirt cuff manufacturing unit according to another embodiment of the present invention.
Figure 9:
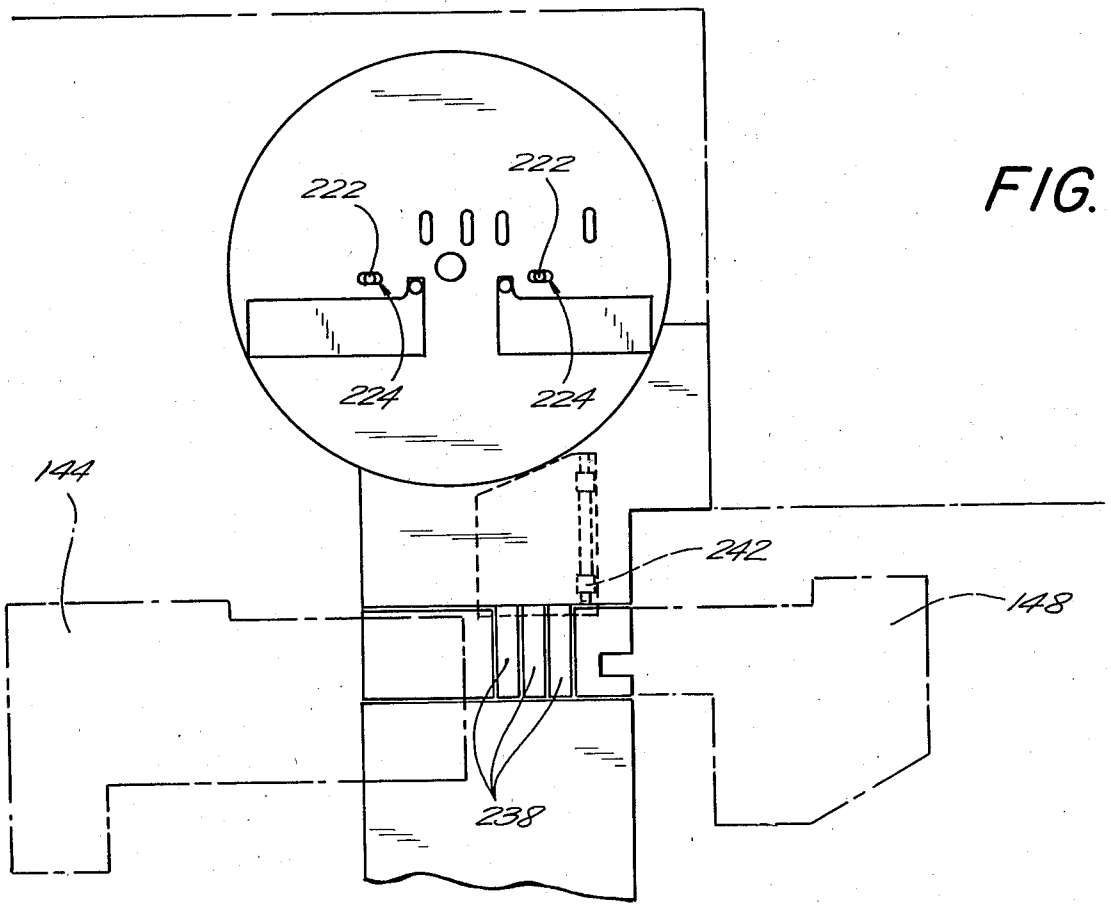
FIG. 9 is a plan view of the rotatable tray of the manufacturing unit of FIG. 8.
Figure 10:
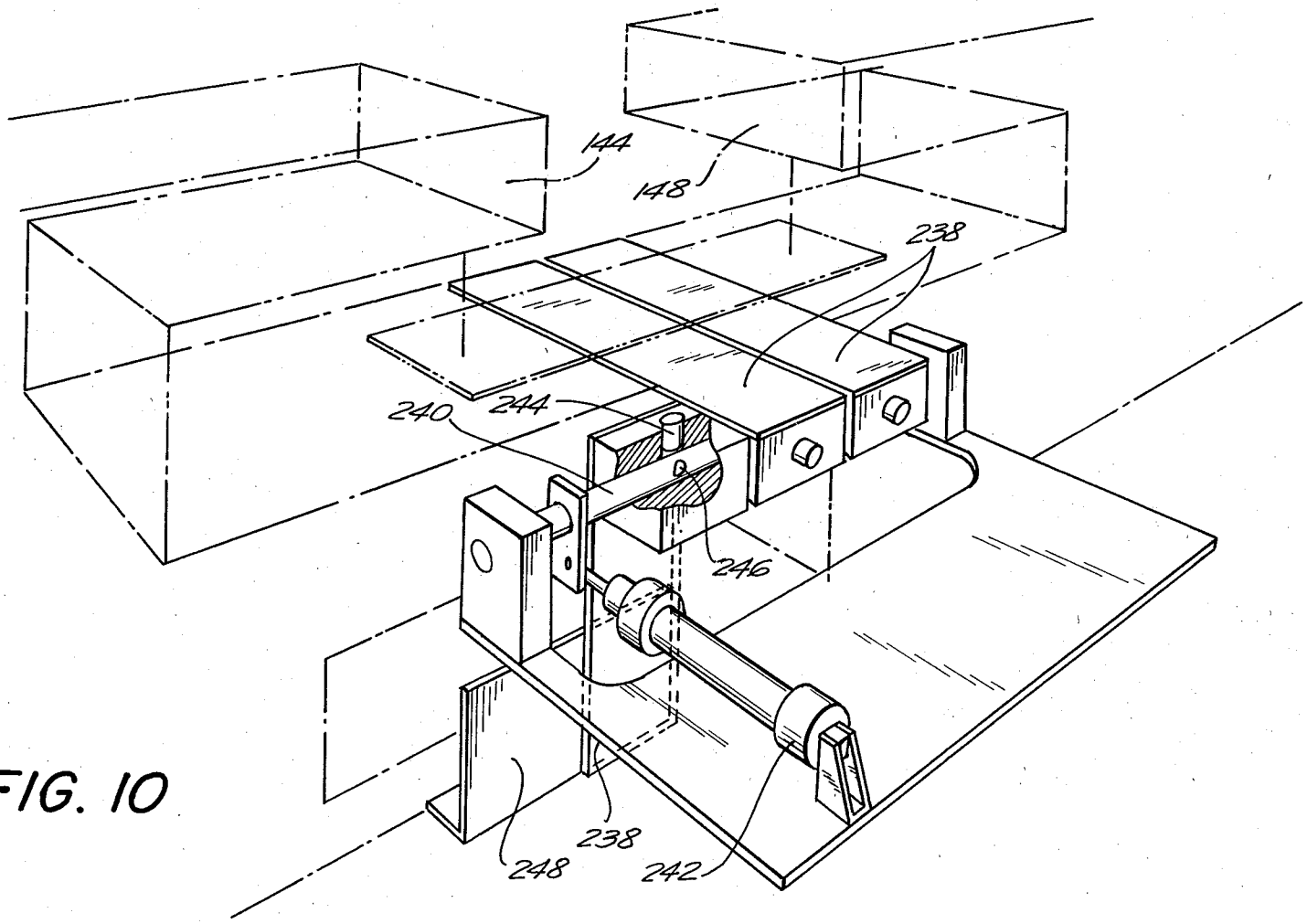
FIG. 10 is a perspective view of a detail of the manufacturing unit of FIG. 8.

FIGS. 8 to 10 show another embodiment of the automatic shirt cuff manufacturing unit. In these figures the elements which are identical or which provide the same functions as elements of the embodiment of FIGS. 1 to 7 carry the same reference numeral as the element corresponding to the first embodiment increased by 100. In order to simplify the drawings, the means for advancing the cuff to the overcast stitching machine, the means for transferring the cuff between this machine and the revolving tray and between the tray and the button sewing and the buttonhole forming machines and the means for removing the completed cuff have not been represented.

In the embodiment of FIGS. 8 to 10, overcast stitching machine 124 and buttonhole forming and button sewing machines 148 and 144 are laid out in line. As a result, for one type of cuff, for example a right hand cuff, it will not be necessary to rotate tray 153 before transferring the cuff to machines 144 and 148, and for the other type of cuff, the tray must be rotated through 180°.

Fingers 135 serving to position the cuff so that the line A–B coincides with diameter 137 of the tray are carried by this tray. The fingers are mounted in rotating manner on a shaft 200 arranged under tray 153 parallel to diameter 137 and whose ends are supported by slides 202 mounted on horizontal rods 204 arranged perpendicular to shaft 200. The movements of shaft 200 and of the fingers 135 parallel to rods 204 are provided by an actuator 136.

Fingers 135 project above the top of tray 153 through slots 206 formed in the tray and parallel to rods 204 (FIG. 8). Counterweights 208 and limit stops limiting the rotation of the fingers on shaft 200 under the action of these counterweights normally hold the fingers in vertical position.

The movement of the moveable system composed of fingers 135, shaft 200 and slides 202 towards the center of the tray is limited by adjustable stops. It is during this movement that the fingers push the cuff causing the line A–B of the cuff to coincide with the diameter 137 of the tray. The movement of this mobile system in the opposite direction brings fingers 135 to stop against the ends of slots 206 furthest from the center of tray 153, then causes the fingers turning on shaft 200 to pivot and to retract under the tray. A locking system serves to deactivate one or more fingers by holding them under the tray throughout the travel of the moveable system.

A moveable arm 210 equipped with a holder 212 and maneuverable by means of a holder arm actuator 214 serves to move the cuff in parallel with diameter 137 after the holder has been applied to the cuff by a pivot actuator 216 which causes the arm to pivot.

Two suspended holders 218 actuated by vertical actuators 220 mounted on hangers fixed on the tray serve to hold the cuff in position on the tray during its rotation.

Two photoelectric cells 222 are placed in openings 224 formed in the tray, parallel to diameter 137 and flush with the upper face of the tray (FIG. 9). These cells are arranged symmetrically with respect to diameter 226 perpendicular to diameter 137. Each cell is associated with a light source so that it is excited whenever a surface acting as a screen is placed above it, on the tray. The position of the cells in the openings is adjustable.

In contrast with buttonhole forming machine 148, which is mounted stationary as in the first embodiment, button setting machine 144 is mounted on a table 228 equipped with guides moveable along bars 230 arranged perpendicular to the direction of travel of the cuff between machine 124, tray 153 and machines 144 and 148. A gear motor 232 whose drive pinion meshes with a rack fixed with respect to table 228 makes it possible to move this table along bars 230 (FIG. 8).

A hanger 234 fixed on table 228 carries on its free end a photoelectric cell 236 associated with a light source. The point of impact of the light rays on the tray emitted by this light source is located on diameter 137 and describes two portions of this diameter when machine 148 moves while the tray is in one or the other of its fixed stop positions. These two portions of the surface of the tray are covered with a reflecting lining so that the current emitted by the cell, which is normally excited by the rays reflected on the tray, diminishes in intensity when an object acting as a screen is placed under the point of impact of the incident rays.

In order to enable machine 144 to move, an empty space must be left between its table and the table of machine 148. To close this space and support the cuff while the button is set in place and the buttonhole is made, use is made of pivoting flaps 238 (see FIG. 10) releasably fixed to horizontal shaft 240 whose rotation is controlled by a flap rotation actuator 242 in order to move the flaps between a horizontal position, in the plane of the tables of machines 144 and 148 and a vertical position, beneath this plane. The flaps are independent of one another and each of them is made releasably fixed on shaft 240 by means of a lock consisting of a ball 244 normally retained by a spring in a cavity 246 of the shaft.

A stop 248 fixed with respect to the table of machine 144 may prevent the upward rotation of one or more flaps, depending on the position of the machine. When stop 248 is in front of a flap, the ball 244 of this flap is released from cavity 246 when the shaft 240 is rotated and only the other flaps are brought to the horizontal position.

To describe the operation of this manufacturing unit, it must first be assumed that the cuff is brought to the tray in the position represented in FIG. 8, i.e., the point A where the button must be attached is on the side of the button sewing machine 144 and, consequently, the point B where the buttonhole is to be formed is on the side of machine 148. The cuff is brought from overcast stitching machine 124 to tray 153 by a transfer arm such as the one described in reference to FIG. 4. Generally, this arm drops the cuff on the tray in a position such that the line A–B does not coincide with the diameter 137 of the tray. This coincidence is obtained by means of fingers 135 which are moved by finger actuator 136 and push the cuff to bring it to the correct position. When this operation is completed, holder 212 is applied to the cuff and arm 210, which was in the retracted position, is moved towards the center of tray 153, moving the cuff with it. When the edge of the cuff located on the side of arm 210 reaches cell 222 located on the same side, this cell which was until then covered by the cuff detects a decrease in the light energy reflected and the resulting signal causes arm 210 to stop, suspended holders 218 to close, holder 212 to move up and arm 210 to retract. The point B is then aligned with the axis 178 of the machine 148. Machine 144 is then moved, by means of gear motor 232, until cell 236 detects the other edge of the cuff by variation in intensity of the reflected light. The cell then causes motor 232 to stop and flaps 238, which were retracted, are brought back to the horizontal position. The point A is then aligned with axis 177 of machine 144. A pincer similar to arm pincer 57 of the first embodiment is then applied to the cuff, suspended holders 218 open up and the cuff is transferred to machines 144 and 148.

If the cuff reaches tray 153 in a reversed position, i.e. if the point A is on the machine 148 side and point B on machine 144 side, it must be turned 180° to bring it to the correct position. The positioning along diameter 137 by means of fingers 135 is obtained as in the first case. The cuff is then pushed by arm 210, which moves towards the center of the tray, but in this case the other cell 222, i.e. the one located on the side of machine 144, is used to detect the other edge of the cuff. When this edge reaches the cell, arm 210 is stopped, suspended holders 218 are applied to the cuff, holder 212 is raised and arm 210 retracted. Then tray 153 is rotated through 180° by means of the rotary pneumatic drive 83. The cycle then returns to the previous case and the following operations are the same: movement of the machine 144 which takes its place with respect to the edge of the cuff located on its side, setting in place of flaps 238, raising of suspended holders 218 and transfer of the cuff to machines 144 and 148. Tray 153 is then brought back to its initial position by rotating through 180° in the opposite direction and a new cuff can be loaded on to it.

Instead of moving the button sewing machine to position it with respect to the edge of the cuff, one could obviously move the buttonhole forming machine, the other machine then being stationary. Also, any one of the means described may be replaced by a technically equivalent means.

Figure 11:
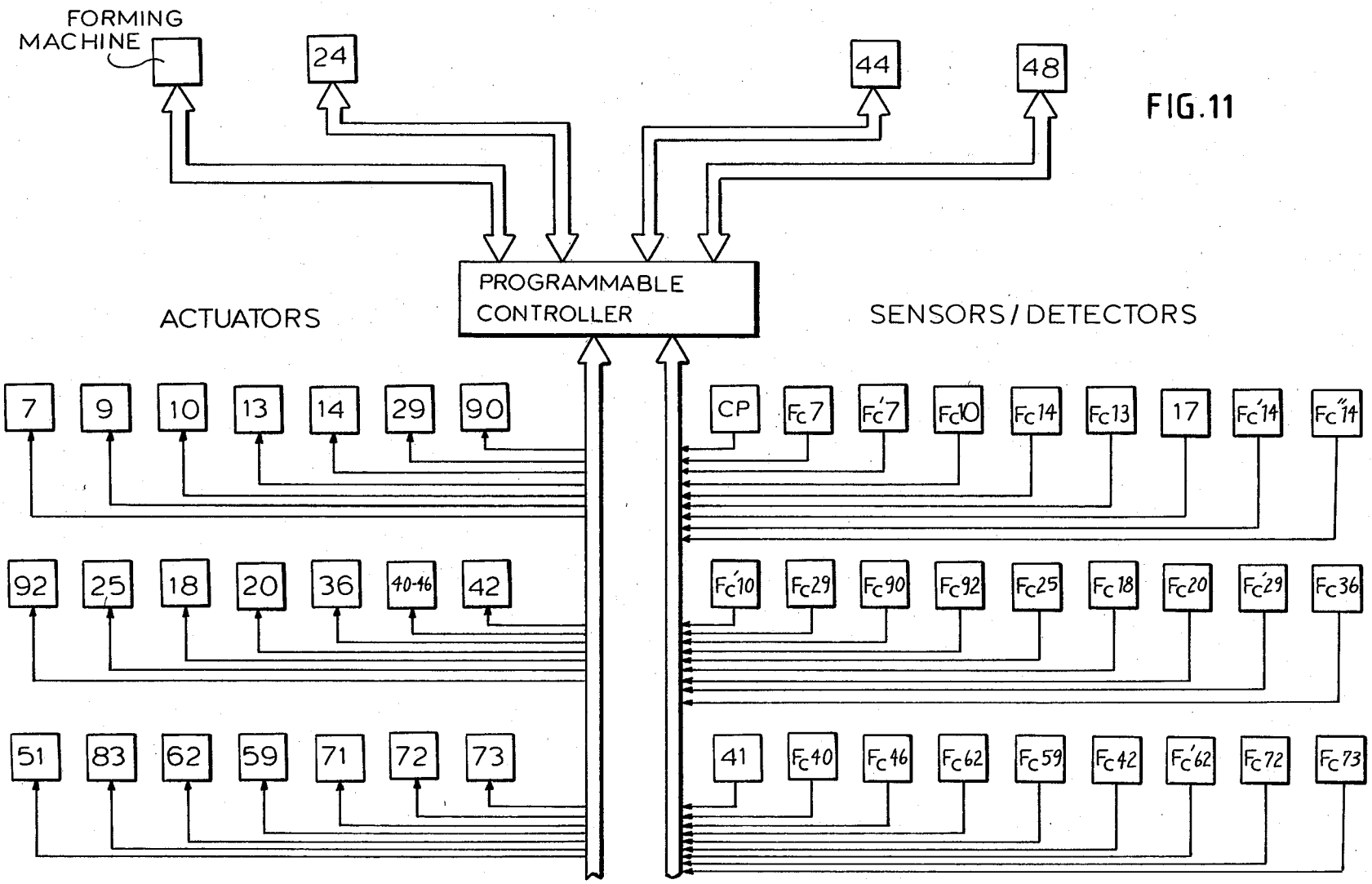
FIG. 11 is a schematic representation of the control system used in the operation of the apparatus of the invention.

The detailed operation of the apparatus is further explained by the following operations table taken in connection with FIG. 11:

TABLE I

INITIAL CONDITIONS cuff 6 is on the tray 4 at the station 5 of the forming machine; the tray is open;
the magazine 34 contains from 1 to 9 cuffs;
cuffs are located on the overcast stitching machine 24, the rotatable tray 53 and on the button setting and buttonhole forming machines 44 and 48, respectively;
the overcast stitching operation takes longer than any of the other operations, i.e., positioning a cuff on the turntable, shaping the buttonhole, and sewing the button.

| OPERATIONS (= steps) | | |
|---|---|---|
| OUTPUT SIGNAL | INPUT SIGNAL FROM | CONTROLLING |
| I. Transferring a cuff from the forming machine to the magazine 34 | | |
| | Photoelectric cell CP sensing the presence of a cuff at station 5 of the forming machine | |
| | | Actuator 7 |
| 1. Grasping arms 8/ Rotary Fixture 10 advance | | |
| | Limit switch Fc7 of actuator 7 | |
| | | Ejection of cuff (not shown) from forming machine tray |
| 2. Grasping arms 8 close | | |
| | | Electromagnets 9 actuator 7 |
| 3. Grasping arms pull back | | |
| | Limit switch Fc'7 of actuator 7 | |
| | | Rotary fixture 10 |
| 4. Grasping arms are rotated to move the base 23 to the level of the table 63 | | |
| | Limit switch Fc10 of rotary fixture 10 | |
| | | Magazine positioner 14 |
| 5. Magazine clamp 12 advances from the holding position 11 to the end of table 63 | | |
| | Limit switch Fc14 of Magazine positioner 14 | |
| | | Magazine clamp actuator 13 |
| 6. Magazine clamp 12 clamps the cuff placed on base 23 | | |
| | Limit switch Fc13 of actuator 13 | |
| | | Electromagnets 9 |
| 7. Grasping arms 8 open | | |
| | | Magazine positioner 14 |
| 8. Magazine clamp 12 and the cuff are moved to the other end of the table 63 | | |
| | Pickup 17 (if there is no cuff in the magazine 34, limit switch Fc'14) | |
| | | Magazine positioner 14 |

TABLE I-continued

| | | |
|---|---|---|
| 9. Magazine clamp 12 is stopped | | |
| | | Magazine clamp actuator 13 |
| 10. Magazine clamp 12 opens | | |
| | | Magazine positioner 14 |
| 11. Reverse motion of magazine clamp 12 | | |
| | Pickup Fc"14 | |
| | | Magazine positioner 14 |
| 12. Magazine clamp 12 is stopped at the holding position 11 | | |
| | | Rotary Fixture 10 |
| 13. Grasping arms rotate by 180° | | |
| | Limit switch Fc'10 | |
| CYCLE RESETS TO BEGINNING OF STEPS 1-13 If storage is full, operations (steps) and forming machine are stopped | | |
| II. Transferring an Overcast-Stitched Cuff From Machine 24 to the Rotatable Tray 53 & Transfer of a Cuff From Magazine 34 to Machine 24 | | |
| | End of program for overcast machine | |
| | | Arm actuator 29 |
| 14. Arm 26 is applied to the cuff | | |
| | Limit switch Fc29 of arm actuator 29 | |
| 15. Shoe 30 of the machine 24 lifts | | |
| | | Actuator 90 |
| 16. Arm 26 and the cuff are moved from machine 24 to rotatable tray 53 | | |
| | | Actuator 92 |
| 17. Stitching machine clamp 16 is clamped on the first cuff of magazine 34 | | |
| | Limit switch Fc90 of actuator 90 | |
| | | Arm actuator 29 |
| 18. Arm 26 is lifted | | |
| | | Actuator 90 |
| 19. Arm 26 is returned to its initial position | | |
| | Limit switch Fc92 of actuator 92 | |
| | | Stitching machine positioner 25 |
| 20. Clamp 16 and the cuff are moved from magazine 34 to the overcast stitching machine 24 | | |
| | | Lever actuator 18 |
| 21. Levers 21 are applied to the cuffs of magazine 34 | | |
| | Limit switch Fc25 of positioner 25 | |
| 22. Program initiation of the machine 24 | | |
| | | Actuator 92 |
| 23. Lifting clamp 16 | | |
| | | Stitching machine positioner 25 |
| 24. Clamp 16 returns to its initial position | | |
| | Limit switch Fc18 of lever actuator 18 | |
| | | Stepping actuator 20 |
| 25. Levers 21 advance | | |

TABLE I-continued

| | | |
|---|---|---|
| by one step | | |
| | Limit switch Fc20 of actuator 20 | |
| | | Lever actuator 18 |
| 26. Levers 21 are lifted | | |
| | | Stepping actuator 20 |
| 27. Levers 21 return to their initial position | | |
| | End of overcast stitching machine program | |
| RESET TO BEGINNING OF CYCLE OF STEPS 14 THROUGH 27 | | |
| III. Positioning the Cuff on Rotatable Tray 53 | | |
| | Limit switch Fc'29 of arm actuator 29 | |
| | | Finger actuator 36 |
| 28. Cuff is displaced on the table by the fingers 35 to make the line 27 coincide with the diameter 37 | | |
| | Limit switch Fc36 of arm actuator 36 | |
| | | Arm actuator 36 |
| 29. Fingers 35 are withdrawn | | |
| | | Actuators moving carriages 40 and 46 |
| 30. Carriages 40 and 46 are moved to the center of the table | | |
| | Photoelectric cells 41 | |
| | | Electromagnets 42 |
| 31. Cuff clamps 39 and 45 | | |
| | | Electromagnet 51 |
| 32. prong 50 descends | | |
| | Limit switches Fc40 and Fc46 of carriages 40 and 46 | |
| | | Rotary drive 83 |
| 33. Tray rotates by 90° (rotation takes place in either direction depending on operator instructions to automatic apparatus, using keypad, the instructions apply to an entire series of right or left hand cuffs) | | |
| IV. Transferring a Cuff From the Rotary Tray to Machines 44 and 48 and From These to Stacker 65 | | |
| | End of program for machines 44 and 48 | |
| | | Carriage actuator 62 |
| 34. Arm pincers 57 and 58 are moved toward the turntable and the machines 44 and 48 | | |
| | Limit switch Fc62 of carriage actuator 62 | |
| | | Arm actuator 59 |
| 35. Pincers 57 and 58 are clamped | | |
| | Limit switch Fc59 of arm actuator 59 | |
| | | Electromagnets 42 |
| 36. Clamps 39 and 45 are lifted | | |
| | Limit switch Fc42 of electromagnets 42 | |
| | | Actuators of carriages 40 and 46 |

TABLE I-continued

| | | |
|---|---|---|
| 37. Carriages 40 and 46 return to their initial positions | | |
| | | Carriage actuator 62 |
| 38. Pincers 57 and 58 are moved toward the stacker | | |
| | Limit switch Fc'62 of actuator 62 | |
| | | Arm actuator 59 |
| 39. Initiation of programs for the machines 44 and 48 | | |
| 40. Pincers 57 and 58 are lifted | | |
| 41. Inverse rotation by 90° of the turntable to return it into its initial position | | |
| | V. Stacking the Cuffs | |
| | Limit switch Fc'62 of actuator 62 | |
| | | Lateral actuator 71 |
| 42. Offset the pusher 69 and grate 68 | | |
| | | Vertical actuator 72 |
| 43. Grate 68 descends | | |
| | Limit switch Fc72 of actuator 72 | |
| | | Longitudinal actuator 73 |
| 44. Pusher 69 advances | | |
| | Limit switch Fc73 of actuator 73 | |
| | | Vertical actuator 72 |
| 45. Grate 68 rises | | |
| | | Longitudinal actuator 73 |
| 46. Pusher 69 pulls back | | |

While only two embodiments of the present invention have been shown and described, it will be obvious that many changes and modifications may be made thereto without departing from the spirit and scope of the present invention.

What is claimed is:

1. An automatic shirt cuff manufacturing unit including an overcast stitching machine, a buttonhole forming machine and a button sewing machine for sewing the button on the cuff, said manufacturing unit comprising:

means for conveying the cuff to the overcast stitching machine; means for removing the cuff from the overcast stitching machine; means for positioning at least one of the ends of the cuff with respect to at least one of the working heads of the buttonhole forming and button sewing machines, said working heads being arranged facing one another; means for orienting the cuff so that it arrives with the proper orientation or an orientation at 180° to the same under said working heads; means for conveying the cuff under said working heads and holding it in the correct position; and means for removing the cuff from the buttonhole forming and button sewing machines.

2. The manufacturing unit according to claim 1, wherein the means for positioning the cuff are adapted to adjust the relative positions of the ends of said cuff in order to arrange them at a predetermined distance from one another, said distance corresponding to the distance between the working heads of the buttonhole forming and button sewing machines.

3. The manufacturing unit according to claim 1, wherein the means for positioning the cuff are arranged to move said cuff longitudinally in order to position one of it ends with respect to the working head of one of the buttonhole forming and button sewing machines, said machine being stationary, to detect the other end of the cuff by detector means and to control, by said detector means, the movement of the other of said machines which is moveable, so as to adjust the distance between the working heads of the machines to the size of the cuff.

4. The manufacturing unit according to claim 1, wherein the means for orienting the cuff comprise a vertical axis rotatable tray positioned on the same plane as the tables of the overcast stitching machine and buttonhole forming and button sewing machines.

5. The manufacturing unit according to claim 4, wherein the means for positioning the cuff further comprises a pushing device which moves the cuff on said tray to bring the line defined by the button-buttonhole of the cuff in coincidence with a diameter of said rotatable tray, said device includes a plurality of retractable fingers perpendicularly moveable with respect to said diameter.

6. The manufacturing unit according to claim 5, wherein said pushing device is fixedly mounted with respect to said manufacturing unit.

7. The manufacturing unit according to claim 5, wherein said pushing device is carried on said rotatable tray.

8. The manufacturing unit according to claim 7, wherein said fingers of said pushing device are rotatably mounted on a shaft arranged under said tray parallel to said diameter, said fingers projecting above said tray through slots perpendicular to said diameter, said fingers being linearly moveable in said slots by means of a finger actuator acting on said shaft.

9. The manufacturing unit according to claim 8, wherein said fingers are normally held in a vertical position by counterweights and pivot to retract when they are pushed by said finger actuator and stop against one end of said slots.

10. The manufacturing unit according to claim 4, wherein the means for positioning the cuff further comprises two arm pincers carried by the rotatable tray and moveable by means of carriages to bring towards each other the ends of the cuff until the distance separating them corresponds to the distance between the working heads of the button sewing and buttonhole forming machines.

11. The manufacturing unit according to claim 10, which further comprises means which forms, during the bringing towards each other of the ends of the cuff, a buckle in the cuff which seats in a channel formed in said revolving tray along a diameter perpendicular to the direction of travel of said pincers.

12. The manufacturing unit according to claim 11, wherein said means comprises a prong which pushes against the cuff to push it into said channel and form said buckle.

13. The manufacturing unit according to claim 4, wherein the means for positioning the cuff further comprises a cuff clamp adapted to engage with the cuff and move it longitudinally along the tray, and means carried by the tray to detect an edge of the cuff and cause said clamp to stop when this edge is correctly positioned with respect to one of the button sewing and buttonhole forming machines.

14. The manufacturing unit according to claim 13, wherein said detection means is mounted on the free end of a hanger fixedly connected to the mobile machine of the buttonhole forming and button sewing machines and which is positioned above the tray.

15. The manufacturing unit according to claim 14, wherein the rotatable tray carries two suspended holders controlled by two vertical actuators for holding the cuff on the tray.

16. The manufacturing unit according to claim 15, which further comprises a plurality of flaps mounted to pivot about a horizontal axis so as to be positionable between the button sewing and the buttonhole forming machines level with the tables of said machines, and to retract by pivoting downwardly to allow the moveable machine of these machines to move.

17. The manufacturing unit according to claim 4, wherein the directions of travel of the cuff between the overcast stitching machine and the rotatable tray on the one hand, and between the rotatable tray and the button sewing and buttonhole forming machines on the other hand, are parallel and additional means are provided for rotating the tray between two positions at 180° to one another which positions are fixed by stops.

18. The manufacturing unit according to claim 4, wherein the directions of travel of the cuff between the overcast stitching machine and the rotatable tray on the one hand, and between said tray and the button sewing and buttonhole forming machines on the other hand, are perpendicular and means are provided to rotate said tray from a central position, fixed by retractable stops, to one or the other of two positions at 90° to the central position which are fixed by stops.

19. The manufacturing unit according to claim 1, which further comprises a forming machine positioned upstream from the overcast stitching machine and means for transferring the cuff from the forming machine to the overcast stitching machine which includes a grasping device adapted to pick up the cuff and bring it to the table of the overcast stitching machine where it is taken by a pincer, said grasping device consisting of a pair of grasping arms controlled by two electromagnets mounted on a base fixed to the rotor of a rotary fixture adapted to turn over said base and to invert the position of the cuff in order for it to be picked up by the means for conveying the cuff to the overcast stitching machine.

20. The manufacturing unit according to claim 19, which further comprises a magazine provided between the grasping device and the overcast stitching machine.

21. The manufacturing unit according to claim 20, which further comprises a magazine clamp controlled by a pneumatic cylinder actuator for picking up the cuff for bringing said cuff to a position of the magazine and a detector fixed with respect to the pincer provided for detecting the presence of the cuffs, said detector causing said pincer to stop at the position of the magazine immediately preceding an occupied position therein.

22. The manufacturing unit according to claim 21, wherein each cuff released by the magazine clamp is held on the table of the magazine by suction openings.

23. The manufacturing unit according to claim 21, wherein the cuff is advanced in a step-wise manner by levers mounted on a shaft which is moved longitudinally by a stepping cylinder actuator, the rotation of the shaft being controlled by a lever actuator for applying the fingers on the cuff.

24. The manufacturing unit according to claim 1, wherein the means for removing the cuff from the overcast stitching machine comprises a clamp bearing arm pivotable about a horizontal axis by means of an arm actuator.

25. The manufacturing unit according to claim 1, wherein the means for conveying the cuff under the working heads of the buttonhole forming and button sewing machines, for holding said cuff in position and for removing it from said machines, comprises a transfer arm equipped with two arm pincers controlled by a single pneumatic cylinder arm actuator, the pincers and actuator being moved by a carriage guided by a ball type shaft-bushing system and being driven by a shaftless pneumatic carriage actuator, and one of the pincers brings the cuff under said working heads, while the other pincer removes said cuff after it has received its button and buttonhole.

26. The manufacturing unit according to claim 25, which further comprises a channel adapted to receive the buckle formed by the cuff located in the table of the button sewing and buttonhole forming machines, and said other pincer which removes the cuff holds the same by one edge only in order to enable it to open flat on said table when leaving said channel whose bottom consists of an inclined plane downstream of said button sewing and buttonhole forming machines.

* * * * *